US009442414B2

(12) United States Patent
Nagashima et al.

(10) Patent No.: US 9,442,414 B2
(45) Date of Patent: Sep. 13, 2016

(54) IMAGE FORMING APPARATUS THAT REDUCES DEVELOPMENT GAP VARIATION AT BOTH END PORTIONS OF DEVELOPING ROLLER

(71) Applicant: Kyocera Document Solutions Inc., Osaka (JP)

(72) Inventors: Teruhiko Nagashima, Osaka (JP); Daisuke Fujiwara, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/833,089

(22) Filed: Aug. 22, 2015

(65) Prior Publication Data

US 2016/0054677 A1 Feb. 25, 2016

(30) Foreign Application Priority Data

Aug. 22, 2014 (JP) ..... 2014-169787

(51) Int. Cl.

| | |
|---|---|
| ***G03G 15/04*** | (2006.01) |
| ***G03G 15/06*** | (2006.01) |
| ***G03G 15/08*** | (2006.01) |
| ***G03G 21/16*** | (2006.01) |

(52) U.S. Cl.

CPC ..... *G03G 15/065* (2013.01); *G03G 15/0806* (2013.01); *G03G 15/0865* (2013.01); *G03G 21/1647* (2013.01); *G03G 2221/1657* (2013.01)

(58) Field of Classification Search

CPC ..... G03G 15/065; G03G 15/0865; G03G 15/0896; G03G 15/757

USPC ..... 399/111, 119, 167

See application file for complete search history.

(56) References Cited

U.S. PATENT DOCUMENTS

| | | | |
|---|---|---|---|
| 2002/0181974 | A1 | 12/2002 | Sekiguchi |
| 2009/0123194 | A1 | 5/2009 | Hatano |
| 2012/0099905 | A1 | 4/2012 | Hatano |

FOREIGN PATENT DOCUMENTS

| | | | |
|---|---|---|---|
| JP | H05-035076 | A | 2/1993 |

*Primary Examiner* — Hoang Ngo

(74) *Attorney, Agent, or Firm* — James Judge

(57) ABSTRACT

An image forming apparatus includes an image forming apparatus body, a first driving mechanism, a first drive unit, an image carrier, a developing device, and a biasing member. The first drive unit includes an input unit to which a rotary drive power is transmitted from the first driving mechanism. The developing device is removably attachable to the image forming apparatus body. The biasing member biases the developing device toward the image carrier side. The developing device includes a developing roller supplying toner onto the image carrier, and a developing unit housing and supporting the developing roller. The first drive unit is located at one end portion in an axial direction of the developing roller. The developing unit swings to come close to the image carrier by the biasing member biasing the developing unit. The developing unit is swingable with respect to the first drive unit.

3 Claims, 11 Drawing Sheets

IMAGE FORMING APPARATUS THAT REDUCES DEVELOPMENT GAP VARIATION AT BOTH END PORTIONS OF DEVELOPING ROLLER

INCORPORATION BY REFERENCE

This application is based upon, and claims the benefit of priority from, corresponding Japanese Patent Application No. 2014-169787 filed in the Japan Patent Office on Aug. 22, 2014, the entire contents of which are incorporated herein by reference.

BACKGROUND

Unless otherwise indicated herein, the description in this section is not prior art to the claims in this application and is not admitted to be prior art by inclusion in this section.

An image forming apparatus performs to develop a latent image formed on an image carrier, which is constituted of such as a photoreceptor, with a developing device to visualize the latent image as a toner image. The developing device houses a developer including toner in a developing container, includes a developing roller supplying the image carrier with developer, and includes a stir conveying member supplying the developing roller with the developer housed in the developing container with stirring and conveying the developer.

For ensuring a satisfactory image quality, a space between an outer peripheral surface of the developing roller and an outer peripheral surface of a photoreceptor drum (development gap) should be held with high accuracy. In view of this, an image forming apparatus including a developing pulley located at both ends of a rotation shaft of the developing roller and a pressing member located to press the developing roller to the photoreceptor drum is widely employed. In this image forming apparatus, the developing pulley is in contact with the outer peripheral surface of the photoreceptor drum and is rotationally driven with respect to the photoreceptor drum. This ensures the developing roller to rotate with respect to the photoreceptor drum in a state keeping a predetermined development gap.

A typical developing device employs a configuration including a development drive unit to rotatably drive the developing roller in the developing device and transmitting a rotary drive power from the developing device main body side to the development drive unit via a gear. Alternatively, it is also employed that a configuration including a replenishment drive unit to rotatably drive a toner replenishment screw of a toner replenishment container in the developing device and transmitting a rotary drive power from the developing device main body side to the replenishment drive unit via a gear.

An image forming apparatus transmitting a rotary drive power to a developing roller via a gear has been proposed.

SUMMARY

An image forming apparatus according to one aspect of the disclosure includes an image forming apparatus body, a first driving mechanism, a first drive unit, an image carrier, a developing device, and a biasing member. The first driving mechanism is located in the image forming apparatus body. The first drive unit includes an input unit to which a rotary drive power is transmitted from the first driving mechanism. The image carrier carries an electrostatic latent image. The developing device is removably attachable to the image forming apparatus body. The developing device forms a toner image on the surface of the image carrier. The toner image corresponds to the electrostatic latent image. The biasing member biases the developing device toward the image carrier side. The developing device includes a developing roller supplying toner onto the image carrier, and a developing unit housing and supporting the developing roller. The first drive unit is located at one end portion in an axial direction of the developing roller. The developing unit swings to come close to the image carrier by the biasing member biasing the developing unit. The developing unit is swingable with respect to the first drive unit.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
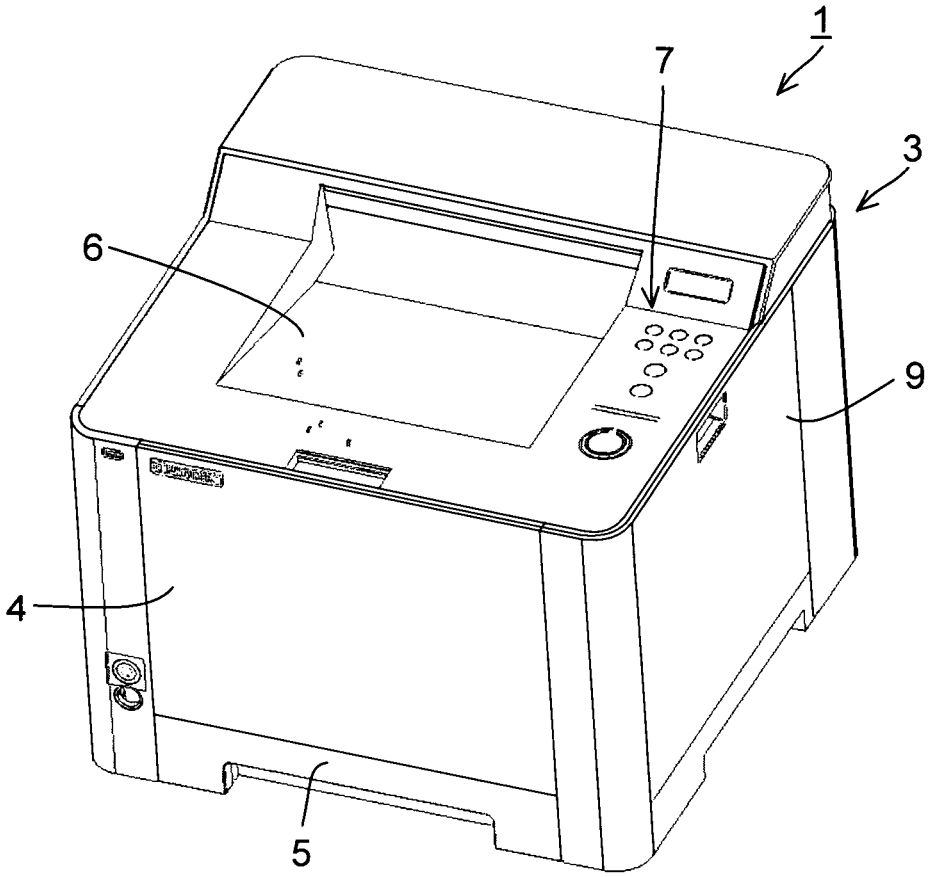
FIG. 1 illustrates an overall configuration of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes embodiments of the disclosure with reference to the drawings.

A description will be given of an image forming apparatus 1 according to one embodiment of the disclosure with reference to FIG. 1 to FIG. 13. As illustrated in FIG. 1, the image forming apparatus 1 includes an apparatus main body (image forming apparatus body) 3 with an approximately hexahedron structure. A front side portion of the apparatus main body 3 facing to a user includes a front cover 4 and a paper sheet cassette 5. The front cover 4 is mounted so as to be freely open and close facing to the apparatus main body 3. When opened, the front cover 4 functions as a manual paper feed tray. The paper sheet cassette 5 is removably mounted on the apparatus main body 3. On the top of the apparatus main body 3, a discharge tray 6 for paper sheets discharged and an operation unit 7 including such as a plurality of buttons are located.

The apparatus main body 3 internally includes an image forming unit, a fixing unit, a paper sheet conveyance passage, and similar unit (not shown). The image forming unit transfers a toner image to a supplied paper sheet based on image data retrieved from a host device such as a PC to form an image. The image forming unit includes a photoreceptor drum 8, a charging unit, an exposure unit, a developing device 2, a transfer roller, a cleaning blade, and similar unit. The photoreceptor drum 8 carries an electrostatic latent image (described below). The charging unit charges the surface of the photoreceptor drum 8. The exposure unit forms the electrostatic latent image corresponding to a document image on the surface of the photoreceptor drum 8 with such as a laser beam. The developing device 2 attaches developer to the formed electrostatic latent image to form a toner image (described below). The transfer roller transfers the toner image to a paper sheet. The cleaning blade removes a toner remaining on the surface of the photoreceptor drum. The fixing unit heats and applies pressure to the paper sheet, on which the toner image is transferred, to fix the toner image on the paper sheet.

On the right-side surface of the apparatus main body 3, a cover member 9 is mounted so as to be freely open and close facing to the apparatus main body 3. The developing device 2 described below is replaceable from the right-side surface of the apparatus main body 3 by opening the cover member 9.

Next, a description will be given of a detail structure of a periphery of the developing device 2. The image forming apparatus 1 is a tandem type color printer, and includes the developing devices 2 and the photoreceptor drums (image carriers) 8 corresponding to respective colors of magenta, cyan, yellow, and black. Basically, the developing devices 2 each have a similar configuration and perform similarly. Also, basically, the photoreceptor drums 8 each have a similar configuration and perform similarly.

Figure 2:
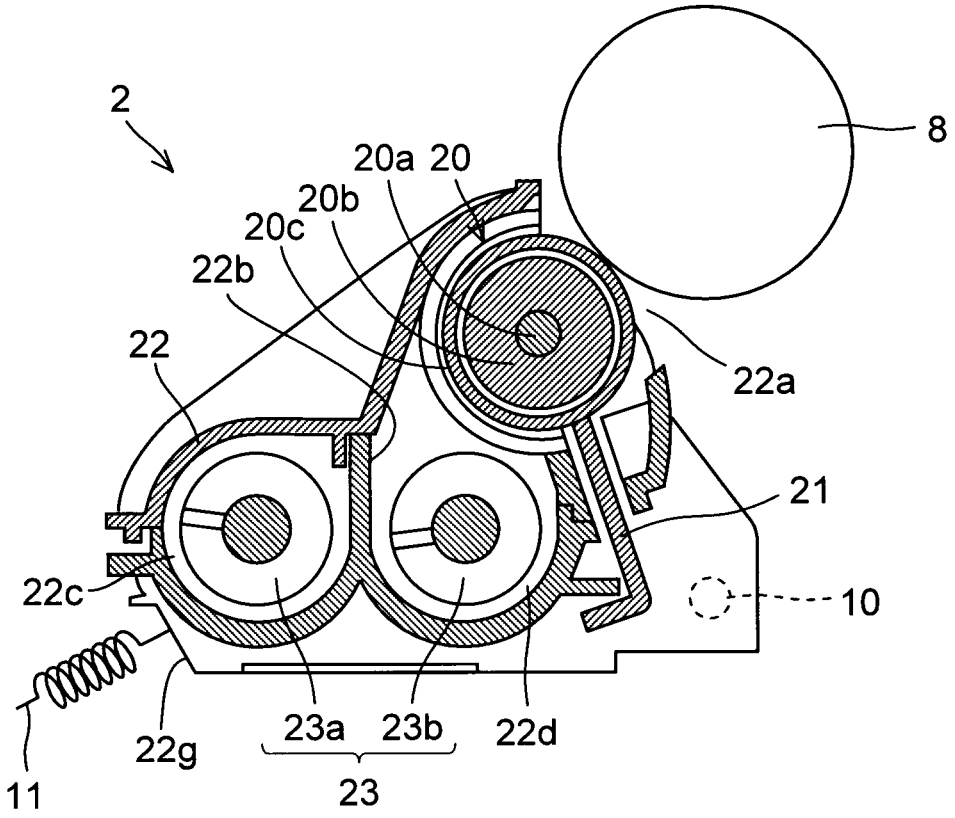
FIG. 2 illustrates a structure of a developing device of the image forming apparatus according to the one embodiment.

As illustrated in FIG. 2, the developing device 2 is constituted of a developing roller (developer carrier) 20, a regulating blade 21, a stir conveying member 23, a developing container (developing unit) 22, and similar unit.

The developing container 22 constitutes the outside of the developing device 2. At the lower portion of the developing container 22, the developing container 22 is divided into a first conveying chamber 22*c* and a second conveying chamber 22*d* by a partition portion 22*b*. The first conveying chamber 22*c* and the second conveying chamber 22*d* house a developer containing a magnetic carrier and a toner. The developing container 22 rotatably holds the stir conveying member 23 and the developing roller 20. Further, the developing container 22 includes an opening 22*a* that exposes the developing roller 20 toward the photoreceptor drum 8.

The developing roller 20 faces to the photoreceptor drum 8. The developing roller 20 is located adjacent to the photoreceptor drum 8 with a predetermined space. The developing roller 20 supplies the photoreceptor drum 8 with toner. The stir conveying member 23 is located approximately downward of the developing roller 20. The regulating blade 21 is fixed and held onto the developing container 22 at the right obliquely downward of the developing roller 20.

The developing roller 20 includes a rotation shaft 20*a*, a magnetic pole member 20*b*, a development sleeve 20*c*, which is formed of a non-magnetic metallic material in a cylindrical shape, and similar component.

The rotation shaft 20*a* is rotatably supported to the developing container 22. This rotation shaft 20*a* holds the development sleeve 20*c* so as to rotate integrally with the rotation shaft 20*a*. Further, the rotation shaft 20*a* holds the magnetic pole member 20*b* made of a magnet at a position facing to a second spiral 23*b* with a predetermined distance from the development sleeve 20*c*.

As illustrated in FIG. 2, the stir conveying member 23 includes two spirals of a first spiral 23*a* and the second spiral 23*b*. The second spiral 23*b* is located in the second conveying chamber 22*d* below the developing roller 20, while the first spiral 23*a* is located in the first conveying chamber 22*c* adjacently to the left side of the second spiral 23*b*.

The first spiral 23*a* and the second spiral 23*b* stir the developer to charge the toner included in the developer to a predetermined level. This ensures the toner to be held onto carrier. At both end portions of the partition portion 22*b*, which divides the first conveying chamber 22*c* and the second conveying chamber 22*d*, in the long side direction (front and back direction of the paper sheet surface in FIG. 2), communication units are located. When the first spiral 23*a* rotates, the charged developer is conveyed from the one communication unit located on the partition portion 22*b* to the second spiral 23*b*, and the developer circulates in the first conveying chamber 22*c* and the second conveying chamber 22*d*. Then, the second spiral 23*b* supplies the developing roller 20 with the developer.

Figure 3:
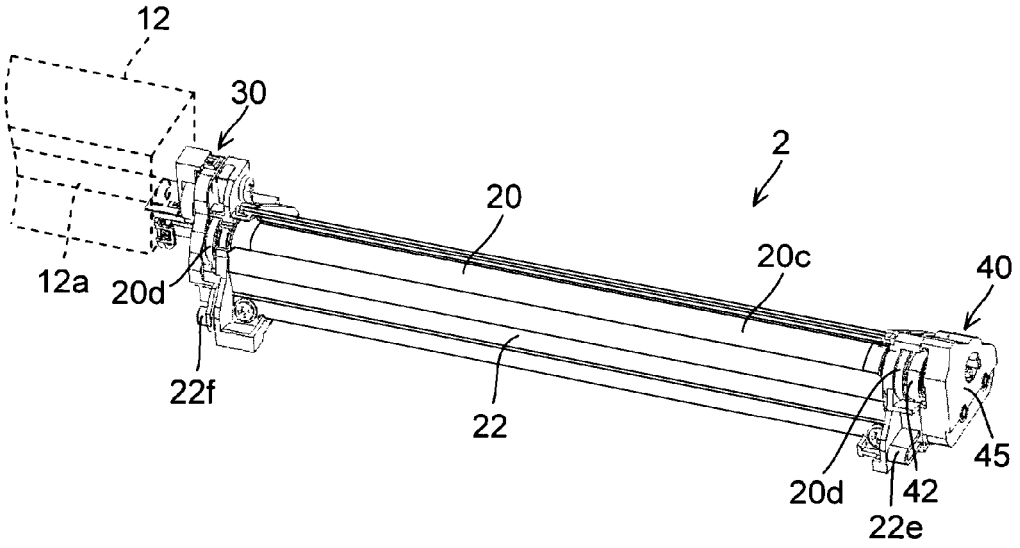
FIG. 3 illustrates a structure at a periphery of the developing device of the image forming apparatus according to the one embodiment.
Figure 4:
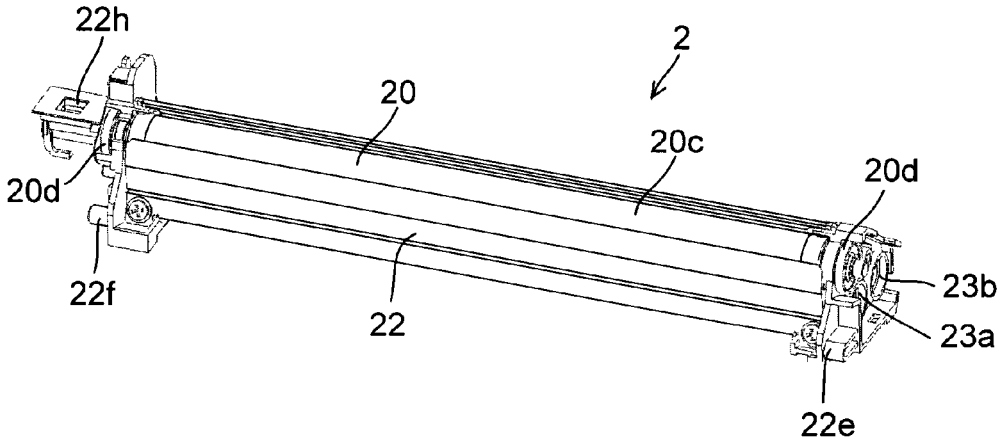
FIG. 4 illustrates a structure of the developing device of the image forming apparatus according to the one embodiment.
Figure 5:
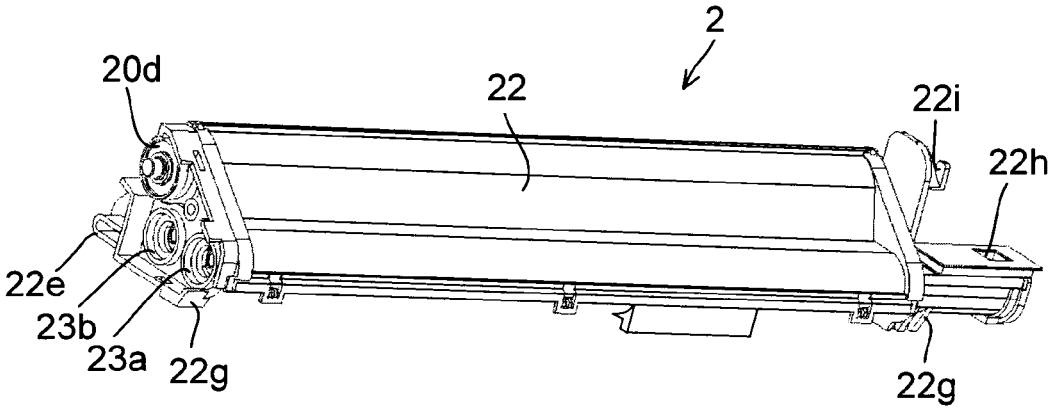
FIG. 5 illustrates a structure of the developing device of the image forming apparatus according to the one embodiment.

The developing container 22 includes bearing portions 22*e* and 22*f* that support a swinging shaft 10 secured to the apparatus main body 3 (see FIG. 3 and FIG. 4). The developing container 22 is configured swingably centering the swinging shaft 10. The developing container 22 includes a pressing surface 22*g* (see FIG. 2 and FIG. 5). When the pressing surface 22*g* is pressed by a biasing member 11 (see FIG. 2), which is constituted of such as a compression coil spring, the developing container 22 swings such that the developing roller 20 comes close to the photoreceptor drum 8.

As illustrated in FIG. 4, at both ends of the rotation shaft 20*a* of the developing roller 20, developing pulleys 20*d* are located. The developing pulley 20*d* has a radius formed in a size where a size of the development gap is added to the radius of the development sleeve 20*c*. In view of this, when the developing pulleys 20*d* are in contact with the outer peripheral surface of the photoreceptor drum 8 and rotationally driven by the photoreceptor drum 8, the developing roller 20 rotates with respect to the photoreceptor drum 8 in a state keeping a predetermined development gap.

As illustrated in FIG. 3, at one end portion and the other end portion of the developing container 22 in the longer side direction (axial direction of the developing roller 20), a replenishment drive unit (first drive unit) 30 and a development drive unit (second drive unit) 40 are respectively located.

Figure 6:
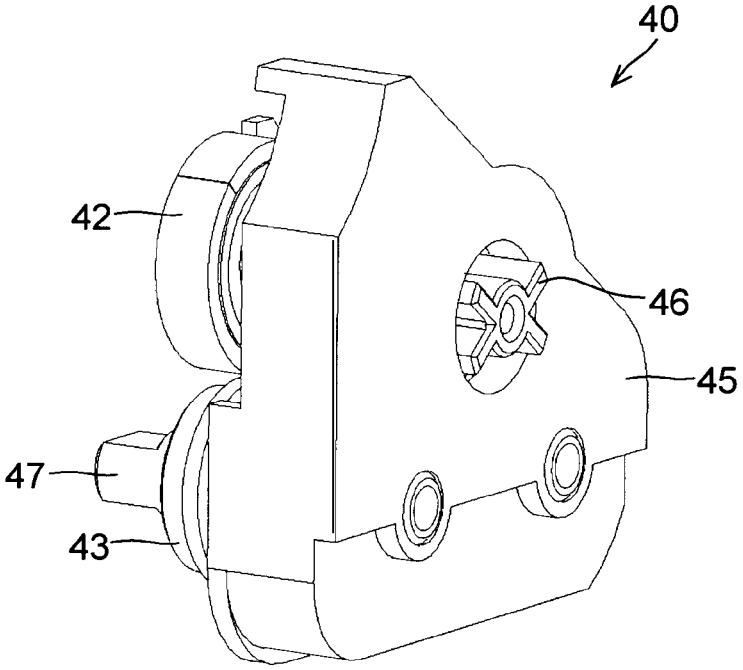
FIG. 6 illustrates a structure of a development drive unit of the image forming apparatus according to the one embodiment.
Figure 7:
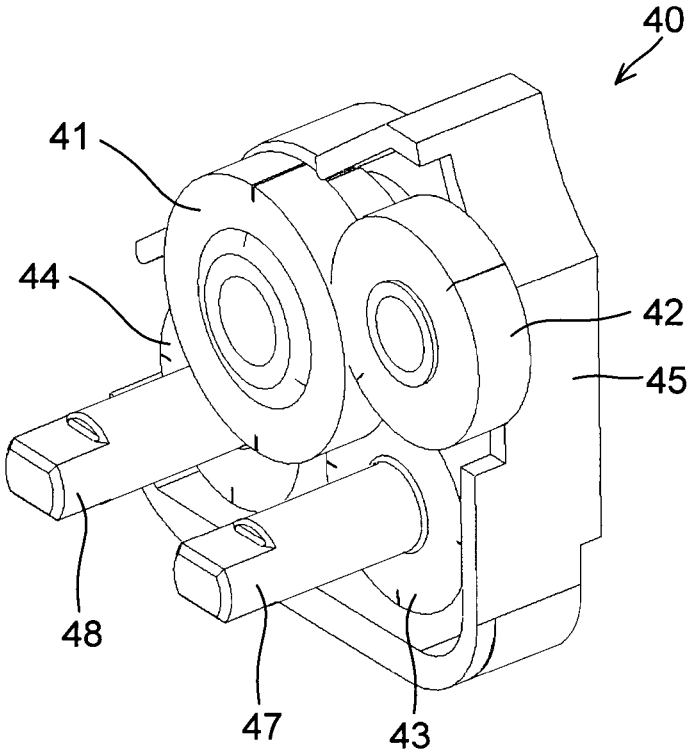
FIG. 7 illustrates a structure of the development drive unit of the image forming apparatus according to the one embodiment.

The development drive unit 40 transmits rotary drive power to the developing roller 20 and the stir conveying member 23. As illustrated in FIG. 6 and FIG. 7, the development drive unit 40 includes an input gear 41, a developing roller gear 42, transmission gears 43 and 44, and a cover member 45, which covers the side portion of these gears.

The input gear 41 is configured to receive the rotary drive power from a development driving mechanism (second driving mechanism) via a coupling joint 46. The development driving mechanism includes a motor, a gear train, and similar component, which are located in the apparatus main body 3 (not shown). The input gear 41 is configured to transmit the rotary drive power to the developing roller gear 42 and the transmission gears 43 and 44.

The developing roller gear 42 is secured to an end portion of the rotation shaft 20*a* of the developing roller 20. The developing roller gear 42 is configured to transmit the rotary drive power to the development sleeve 20*c* of the developing roller 20 to rotate the development sleeve 20*c*. The transmission gear 43 is secured to a transmission shaft 47 engaging with the second spiral 23*b*, while the transmission gear 44 is secured to a transmission shaft 48 engaging with the first spiral 23*a*. This ensures the development sleeve 20*c*, the first spiral 23*a*, and the second spiral 23*b* to rotate when the input gear 41 rotates.

The development drive unit 40 is secured to the developing container 22. This ensures the development drive unit 40 to swing centering the swinging shaft 10 when the developing container 22 swings centering the swinging shaft 10.

Figure 8:
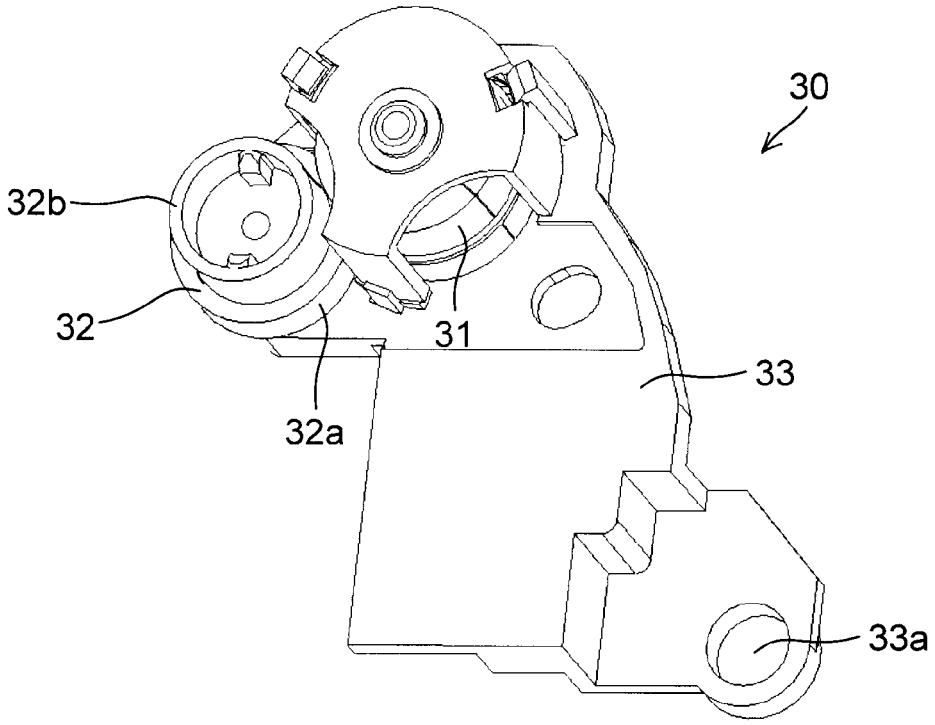
FIG. 8 illustrates a structure of a replenishment drive unit of the image forming apparatus according to the one embodiment.
Figure 9:
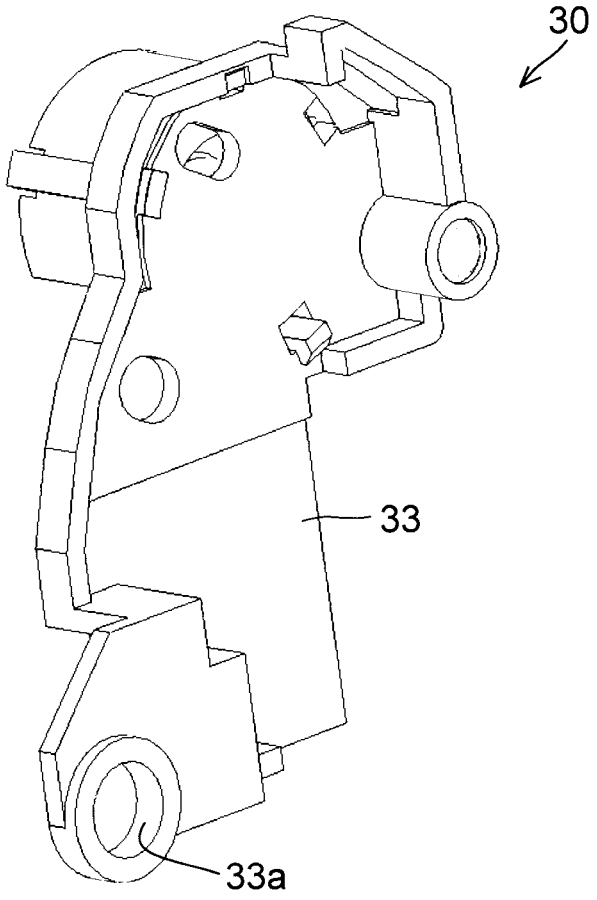
FIG. 9 illustrates a structure of the replenishment drive unit of the image forming apparatus according to the one embodiment.

As illustrated in FIG. 3, the replenishment drive unit 30 transmits the rotary drive power to a toner replenishment screw 12*a* of a toner replenishment container 12, which houses a toner to replenish to the developing device 2. As illustrated in FIG. 8 and FIG. 9, the replenishment drive unit 30 includes an input gear (input unit) 31, a transmission member 32, and a cover member 33, which rotatably supports the input gear 31 and the transmission member 32.

Figure 10:
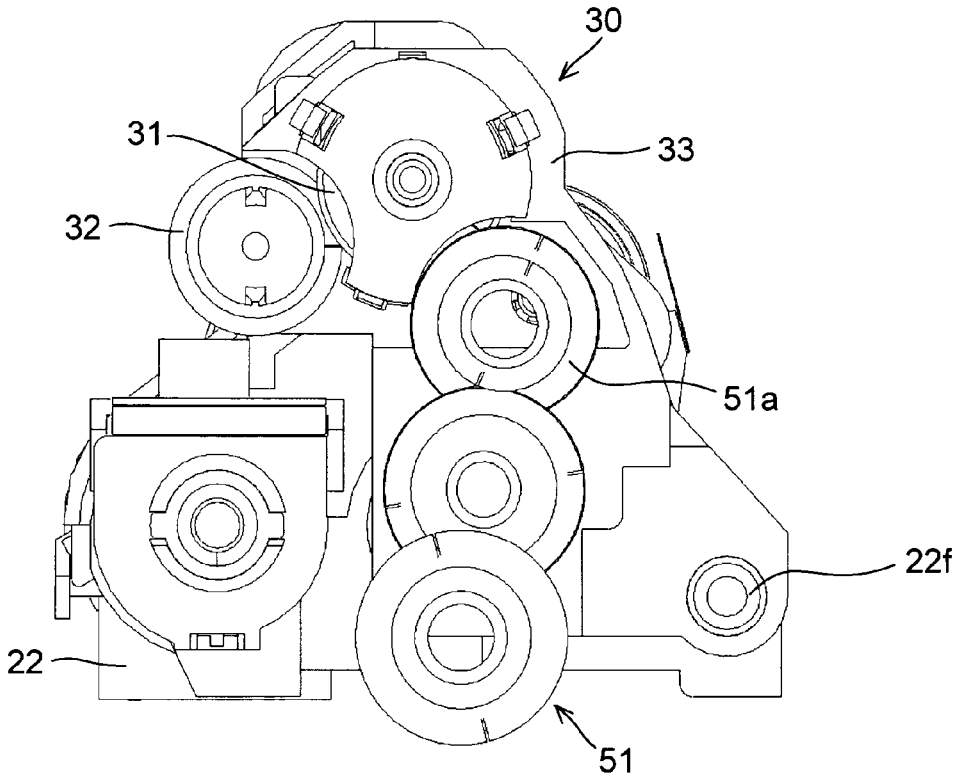
FIG. 10 illustrates a structure of the replenishment drive unit and a developing container of the image forming apparatus according to the one embodiment.

The input gear 31 is configured to receive the rotary drive power from a replenishment driving mechanism (first driving mechanism) 51 via a gear 51*a* (see FIG. 10). The replenishment driving mechanism (first driving mechanism) 51 includes a motor (not shown), a gear train, and similar component, which are located in the apparatus main body 3. The input gear 31 is configured to transmit the rotary drive power to a gear portion 32*a* of the transmission member 32.

The transmission member 32 includes the gear portion 32*a* and an engaging portion 32*b*. The gear portion 32*a* meshes with the input gear 31. The engaging portion 32*b* engages with the toner replenishment screw 12*a* (see FIG. 3) located in the toner replenishment container 12. The transmission member 32 transmits the rotary drive power from the input gear 31 to the toner replenishment screw 12*a* to rotate the toner replenishment screw 12*a*. The rotation of the toner replenishment screw 12*a* causes the toner in the toner replenishment container 12 to be replenished by a predetermined amount from an opening 22*h* (see FIG. 4) located upstream side of the first conveying chamber 22*c* in the developing container 22.

At the lower portion of the cover member 33, an insertion hole 33*a* to which the bearing portion 22*f* of the developing container 22 (see FIG. 4) is inserted is formed. The replenishment drive unit 30 is configured swingably with respect to the developing container 22. On the other hand, the replenishment drive unit 30 is secured to the apparatus main body 3 by positioning of the insertion hole 33*a* and the rotation shaft of the input gear 31. This ensures the developing container 22 to swing with respect to the replenishment drive unit 30 centering the swinging shaft 10. A center shaft for swinging (swinging shaft 10) of the developing container 22 with respect to the replenishment drive unit 30 is located coaxially with a center shaft for swinging (swinging shaft 10) of the developing container 22 with respect to the apparatus main body 3.

Figure 11:
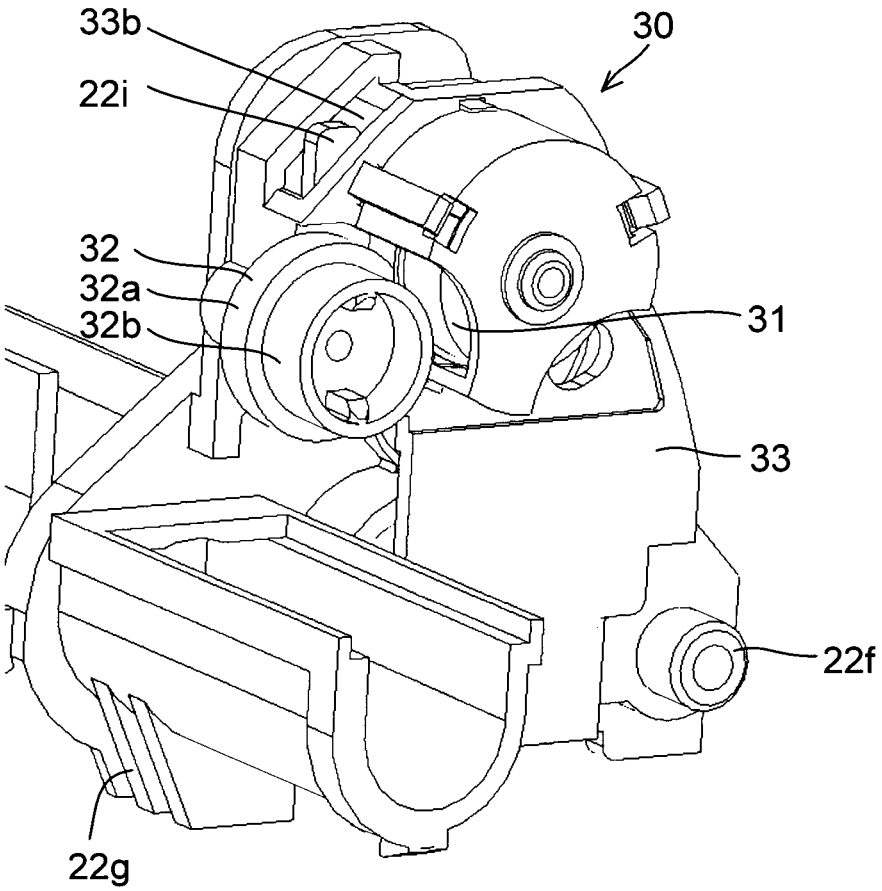
FIG. 11 illustrates a structure of the replenishment drive unit and the developing container of the image forming apparatus according to the one embodiment.

A swing angle (swing range) of the developing container 22 with respect to the replenishment drive unit 30 is regulated. Specifically, as illustrated in FIG. 11, the developing container 22 includes a regulating piece 22*i*, while the cover member 33 has a regulating hole (regulating portion) 33*b* to which the regulating piece 22*i* is inserted. In view of this, when the developing container 22 swings with respect to the replenishment drive unit 30, the developing container 22 can swing within a movable range of the regulating piece 22*i* with respect to the regulating hole 33*b*.

Figure 12:
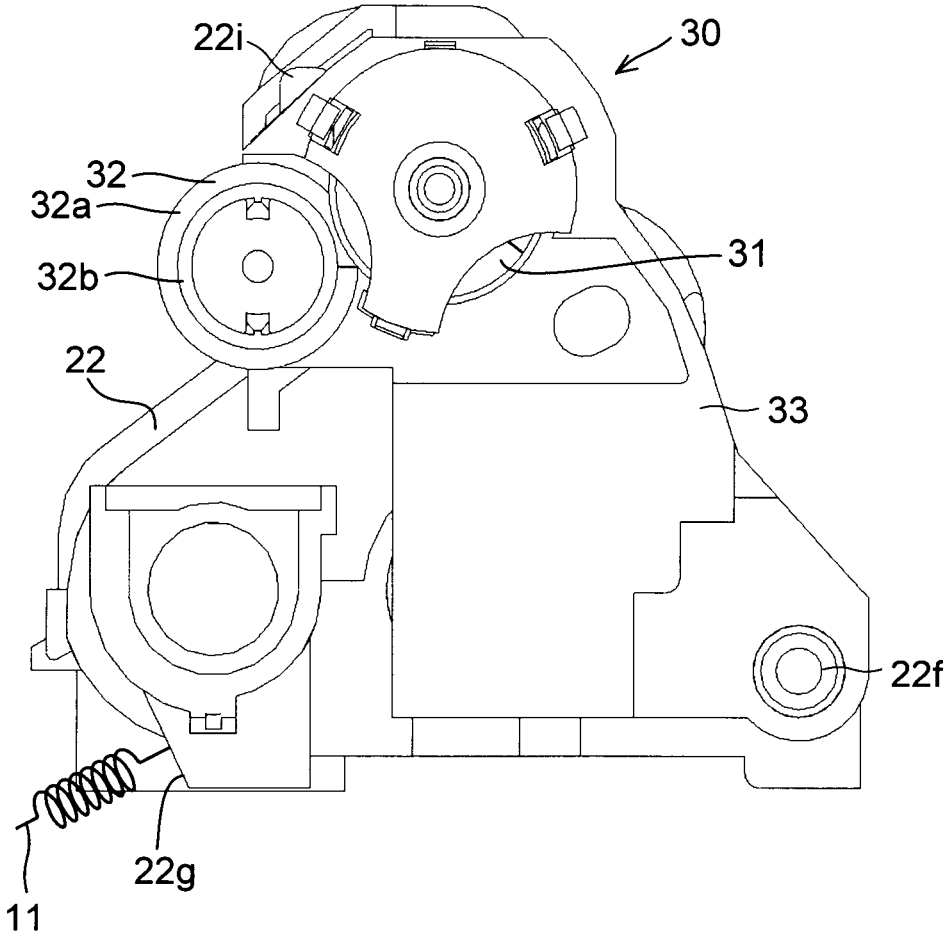
FIG. 12 illustrates a state where the developing container of the image forming apparatus according to the one embodiment does not swing with respect to the replenishment drive unit.
Figure 13:
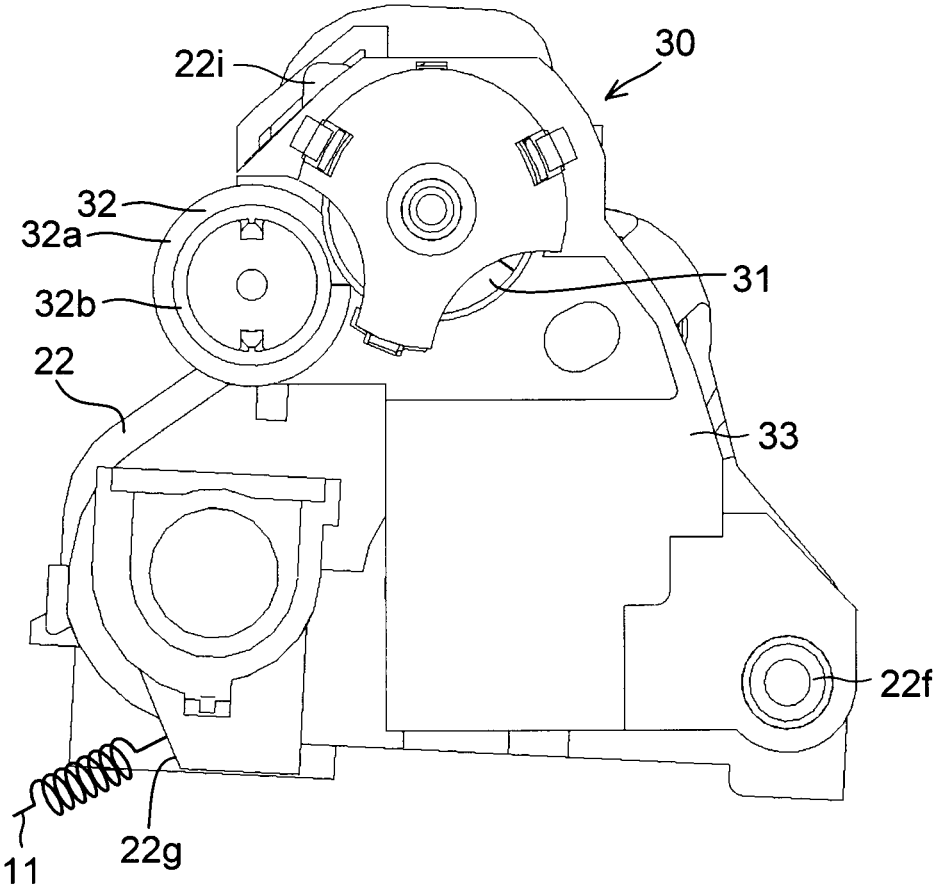
FIG. 13 illustrates a state where the developing container of the image forming apparatus according to the one embodiment swings with respect to the replenishment drive unit in a right rotation direction.

Next, a description will be given of a case where the developing device 2 and the photoreceptor drum 8 are mounted on the apparatus main body 3. Firstly, as illustrated in FIG. 12, the developing container 22, at one end portion and the other end portion of which the replenishment drive unit 30 and the development drive unit 40 are respectively mounted, is mounted to the apparatus main body 3 in a state where the photoreceptor drum 8 is removed. At this time, as illustrated in FIG. 13, pressing the pressing surface 22*g* of the developing container 22 by the biasing member 11 causes the developing container 22 and the development drive unit 40 to swing in the right rotation direction so as to come close to the photoreceptor drum 8. The swing angles of the developing container 22 and the development drive unit 40 are regulated by the regulating piece 22*i* of the developing container 22 and the regulating hole 33*b* of the cover member 33.

Then, mounting the photoreceptor drum 8 from the top surface side of the apparatus main body 3 causes the photoreceptor drum 8 to press the developing pulley 20*d* of the developing roller 20. Accordingly, the developing container 22 and the development drive unit 40 reverse a little (swing in the left rotation direction).

In this embodiment, as described above, the developing container 22 is swingable with respect to the replenishment drive unit 30. This reduces the swing of the developing container 22 due to the rotary drive power, which is transmitted from the replenishment driving mechanism 51 to the replenishment drive unit 30, when the rotary drive power is transmitted from the replenishment driving mechanism 51, which is secured to the apparatus main body 3, to the replenishment drive unit 30. This reduces the variation of development gaps between the developing roller 20 and the photoreceptor drum 8 at both end portions of the developing roller 20, thus ensuring satisfactory image quality.

As described above, when the rotary drive power is transmitted to the replenishment drive unit 30 from the replenishment driving mechanism 51 via the gear 51*a*, the power causes the replenishment drive unit 30 to swing with respect to the developing container 22 with engaging of the gear 51*a* and the input gear 31. However, as described above, securing the replenishment drive unit 30 to the apparatus main body 3 can cause the apparatus main body 3 to absorb the power acting on the replenishment drive unit 30 to swing.

As described above, when the rotary drive power is transmitted to the development drive unit 40 from the development driving mechanism secured to the apparatus main body 3 via the coupling joint 46, the development drive unit 40 may be secured to the developing container 22 because the transmitted rotary drive power is less likely to act on the developing container 22 to swing.

As described above, the center shaft for swinging (swinging shaft 10) of the developing container 22 with respect to the replenishment drive unit 30 is coaxial with the center shaft for swinging (swinging shaft 10) of the developing container 22 with respect to the apparatus main body 3. This achieves space saving compared with the case where the center shaft for swinging of the developing container 22 with respect to the replenishment drive unit 30 is not coaxial with the center shaft for swinging of the developing container 22 with respect to the apparatus main body 3.

As described above, the developing container 22 includes the regulating piece 22*i*, while the replenishment drive unit 30 includes the regulating hole 33*b*. The regulating hole 33*b* regulates the swing range of the developing container 22 with respect to the replenishment drive unit 30 by the regulating piece 22*i* in contact with the regulating hole 33*b*. This ensures regulating the swing range of the developing container 22 with respect to the replenishment drive unit 30 easily.

For example, the above-described embodiment shows an exemplary case where the center shaft for swinging of the developing container 22 with respect to the replenishment drive unit 30 is located coaxially with the center shaft for swinging of the developing container 22 with respect to the apparatus main body 3. However, the disclosure should not be construed in a limiting sense. The center shaft for swinging of the developing container 22 with respect to the replenishment drive unit 30 may be located not coaxially with the center shaft for swinging of the developing container 22 with respect to the apparatus main body 3.

While in the above-described embodiment the developing container 22 is configured swingably with respect to the replenishment drive unit 30 and the development drive unit 40 is secured to the developing container 22, the disclosure should not be construed in a limiting sense. For example, the developing container 22 may be configured swingably with respect to the development drive unit 40. In this case, using such as a flexible joint ensures transmitting the rotary drive power from the development drive unit 40 to the developing container 22 easily. A drive unit other than the replenishment drive unit 30 may be located such that the developing container 22 is configured to be swingable with respect to the drive unit.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an image forming apparatus body;

a first driving mechanism located in the image forming apparatus body;

a first drive unit secured to the image forming apparatus body, the first drive unit including an input unit into which rotary drive power is transmitted from the first driving mechanism;

a gear via which the first drive unit receives the rotary drive power transmitted from the first driving mechanism;

an image carrier that carries an electrostatic latent image;

a developing device removably attachable to the image forming apparatus body, the developing device forming a toner image on the surface of the image carrier, the toner image corresponding to the electrostatic latent image; and a biasing member biasing the developing device toward the image carrier side;

a toner replenishment container housing toner to be replenished to the developing device;

a toner replenishment screw located in the toner replenishment container;

a second driving mechanism located in the image forming apparatus body;

a second drive unit transmitting rotary drive power from the second driving mechanism to the developing roller; and a coupling joint; wherein the developing device includes a developing roller supplying toner onto the image carrier, and a developing unit housing and supporting the developing roller, the first drive unit is located at one end portion in an axial direction of the developing roller, the developing unit swings to come close to the image carrier by the biasing member biasing the developing unit, the developing unit is swingable with respect to the first drive unit, the first drive unit transmits the rotary drive power to the toner replenishment screw, the second drive unit is located at another end portion in the axial direction of the developing roller, and via the coupling joint the second drive unit receives the rotary drive power transmitted from the second driving mechanism.

2. The image forming apparatus according to claim 1, wherein a center shaft for swinging of the developing unit with respect to the first drive unit is located coaxially with a center shaft for swinging of the developing unit with respect to the image forming apparatus body.

3. An image forming apparatus comprising:

an image forming apparatus body;

a first driving mechanism located in the image forming apparatus body;

a first drive unit including an input unit into which rotary drive power is transmitted from the first driving mechanism;

an image carrier that carries an electrostatic latent image;

a developing device removably attachable to the image forming apparatus body, the developing device forming a toner image on the surface of the image carrier, the toner image corresponding to the electrostatic latent image; and a biasing member biasing the developing device toward the image carrier side; wherein the developing device includes a developing roller supplying toner onto the image carrier, and a developing unit housing and supporting the developing roller, the first drive unit is located at one end portion in an axial direction of the developing roller, the developing unit swings to come close to the image carrier by the biasing member biasing the developing unit, the developing unit is swingable with respect to the first drive unit, the developing unit includes a regulating piece, and the first drive unit includes a regulating portion regulating a swing range of the developing unit with respect to the first drive unit with the regulating piece in contact with the regulating portion.

* * * * *